US007993724B2

(12) United States Patent
Chacko et al.

(10) Patent No.: US 7,993,724 B2
(45) Date of Patent: Aug. 9, 2011

(54) INSULATION FOR HIGH TEMPERATURE APPLICATIONS

(75) Inventors: Jacob Chacko, Pickerington, OH (US); Robert P. Collier, Gahanna, OH (US); Edward A. Martine, Newark, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 675 days.

(21) Appl. No.: 11/801,247

(22) Filed: May 9, 2007

(65) Prior Publication Data

US 2008/0280131 A1 Nov. 13, 2008

(51) Int. Cl.
*B32B 3/00* (2006.01)
*D04H 13/00* (2006.01)

(52) U.S. Cl. ..... 428/74; 428/102; 428/364; 428/375; 428/401; 428/426; 442/180; 442/334; 442/335; 442/340; 442/355

(58) Field of Classification Search ..... 428/74, 428/102, 364, 375; 442/126, 136, 152, 172, 442/180, 334, 335, 340, 355
See application file for complete search history.

(56) References Cited

U.S. PATENT DOCUMENTS

| | | | | |
|---|---|---|---|---|
| 3,608,166 | A | | 9/1971 | Gruget |
| 3,829,939 | A | | 8/1974 | Dilo |
| 3,975,565 | A | | 8/1976 | Kendall |
| 4,099,641 | A | | 7/1978 | Schiedat |
| 4,191,304 | A | | 3/1980 | Schiedat |
| 4,237,180 | A | | 12/1980 | Jaskowski |
| 4,418,031 | A | | 11/1983 | Doerer et al. |
| 4,522,876 | A | | 6/1985 | Hiers |
| 4,585,685 | A | | 4/1986 | Forry et al. |
| 4,595,630 | A | * | 6/1986 | Fay ..... 442/180 |
| 4,751,134 | A | | 6/1988 | Chenoweth et al. |
| 4,759,785 | A | | 7/1988 | Barthe et al. |
| 4,844,049 | A | | 7/1989 | Nelson |
| 4,847,140 | A | | 7/1989 | Jaskowski |
| 4,888,235 | A | | 12/1989 | Chenoweth et al. |
| 4,889,764 | A | | 12/1989 | Chenoweth et al. |
| 4,923,547 | A | | 5/1990 | Yamaji et al. |
| 4,940,042 | A | | 7/1990 | Moore et al. |
| 4,946,738 | A | | 8/1990 | Chenoweth et al. |
| 5,055,428 | A | | 10/1991 | Porter |
| 5,100,450 | A | | 3/1992 | Cunningham |
| 5,272,000 | A | | 12/1993 | Chenoweth et al. |

(Continued)

FOREIGN PATENT DOCUMENTS

CN 1204280 1/1999

(Continued)

OTHER PUBLICATIONS

International Search Report PCT/US2006/025071 dated Dec. 20, 2006.

(Continued)

*Primary Examiner* — Gwendolyn Blackwell
(74) *Attorney, Agent, or Firm* — Calfee, Halter & Griswold LLP

(57) ABSTRACT

Insulation for high temperature applications includes glass fibers having an average diameter of between about 2.7 to about 3.8 microns. In one possible embodiment the insulation includes a polyacrylic acid binder. Such insulation has about 98 weight percent glass fibers and about 2 weight percent binder.

23 Claims, 5 Drawing Sheets

U.S. PATENT DOCUMENTS

| | | | |
|---|---|---|---|
| 5,318,990 | A | 6/1994 | Strauss |
| 5,340,868 | A | 8/1994 | Strauss et al. |
| 5,523,264 | A | 6/1996 | Mattson |
| 5,661,213 | A | 8/1997 | Arkens et al. |
| 5,671,518 | A | 9/1997 | Kummermehr et al. |
| 5,674,307 | A | 10/1997 | Huey et al. |
| 5,688,301 | A | 11/1997 | Brandon et al. |
| 5,697,330 | A | 12/1997 | Yetman |
| 5,787,677 | A | 8/1998 | Bolich et al. |
| 5,837,621 | A | 11/1998 | Kajander |
| 5,840,413 | A | 11/1998 | Kajander |
| 5,871,830 | A | 2/1999 | Miller |
| 5,885,390 | A | 3/1999 | Alkire et al. |
| 5,906,669 | A | 5/1999 | Tonder et al. |
| 5,932,499 | A | 8/1999 | Xu et al. |
| 5,972,434 | A | 10/1999 | Kajander |
| 5,980,680 | A | 11/1999 | Miller |
| 5,983,586 | A | 11/1999 | Berdan, II et al. |
| 6,058,892 | A | 5/2000 | Haak, II |
| 6,077,795 | A | 6/2000 | Blinkhorn et al. |
| 6,227,009 | B1 | 5/2001 | Cusick et al. |
| 6,274,661 | B1 | 8/2001 | Chen et al. |
| 6,497,950 | B1 | 12/2002 | Haile et al. |
| 6,527,014 | B1 | 3/2003 | Aubourg |
| 6,564,437 | B2 | 5/2003 | Meng et al. |
| 6,596,048 | B1 | 7/2003 | Tuffal et al. |
| 6,669,265 | B2 | 12/2003 | Tilton et al. |
| 6,699,945 | B1 | 3/2004 | Chen et al. |
| 6,756,332 | B2 | 6/2004 | Sandoe et al. |
| 6,884,849 | B2 | 4/2005 | Chen et al. |
| 6,893,711 | B2 | 5/2005 | Williamson et al. |
| 7,128,561 | B2 | 10/2006 | Rockwell et al. |
| 2002/0134322 | A1 | 9/2002 | Dolan |
| 2002/0137421 | A1 | 9/2002 | Desroches et al. |
| 2002/0160682 | A1 | 10/2002 | Zeng et al. |
| 2003/0167789 | A1* | 9/2003 | Tanimoto et al. ..... 62/457.7 |
| 2004/0050619 | A1 | 3/2004 | Bargo, II |
| 2004/0176003 | A1 | 9/2004 | Yang et al. |
| 2005/0026527 | A1 | 2/2005 | Schmidt et al. |
| 2005/0075030 | A1 | 4/2005 | Coon et al. |
| 2005/0079786 | A1 | 4/2005 | Slkins |
| 2005/0082721 | A1 | 4/2005 | Haque et al. |
| 2005/0115662 | A1 | 6/2005 | Haque et al. |
| 2005/0191921 | A1 | 9/2005 | Tilton et al. |
| 2005/0266757 | A1 | 12/2005 | Roekens et al. |
| 2005/0266758 | A1 | 12/2005 | Nishikori et al. |
| 2006/0137799 | A1 | 6/2006 | Haque et al. |
| 2006/0141884 | A1 | 6/2006 | Haque et al. |
| 2006/0166582 | A1 | 7/2006 | Turkson |
| 2007/0014995 | A1 | 1/2007 | Chacko |
| 2008/0160857 | A1 | 7/2008 | Chacko |
| 2010/0147032 | A1 | 6/2010 | Chacko |
| 2010/0151223 | A1 | 6/2010 | Chacko |

FOREIGN PATENT DOCUMENTS

| | | |
|---|---|---|
| CN | 1515722 | 7/2004 |
| CN | 1619038 | 5/2005 |
| FR | 2337703 | 9/1977 |
| JP | 406116854 A | 4/1994 |
| KR | 078 123 | 10/2003 |
| KR | 028 443 | 4/2004 |
| WO | 07/008412 | 1/2007 |

OTHER PUBLICATIONS

Office action from Chinese Application No. 200680025329.7 dated Sep. 30, 2010.

* cited by examiner

INSULATION FOR HIGH TEMPERATURE APPLICATIONS

TECHNICAL FIELD AND INDUSTRIAL APPLICABILITY OF THE INVENTION

This invention relates generally to the thermal insulation field and, more particularly, to glass fiber insulation particularly adapted for high temperature applications as well as high temperature appliances incorporating such insulation.

BACKGROUND OF THE INVENTION

U.S. Pat. No. 4,759,785 to Barth et al. discloses a glass fiberization method for producing glass fibers having diameters of from 1 to 20 microns. U.S. Pat. No. 5,674,307 to Hughey et al. discloses a method for producing hollow mineral fibers such as glass fibers with an average outside diameter of from about 2.5 to about 125 microns. Thus, the manufacturing of relatively fine glass fibers for use in high temperature insulation applications is known.

United States Patent Application Publication No. US2004/0176003 A1 to Yang et al. discloses an insulation product or mat incorporating rotary glass fibers having an average diameter of about 3 to 5 microns and preferably between 4 and 5 microns, textile glass fibers having an average diameter of about 6 to 20 microns and thermoplastic fibers. As noted the total glass fiber content is about 30 to 50 weight percent of the mat and the textile fiber content is preferably less than about 20 weight percent of the total glass fiber content.

The present invention relates to an insulation for high temperature applications that will provide a better k-value or thermal-insulation at elevated temperatures for a given density than insulation products known in the art.

SUMMARY OF THE INVENTION

In accordance with the purposes of the present invention as described herein, an improved insulation is provided for high temperature applications. The insulation comprises glass fibers having an average diameter of between about 2.7 to about 3.8 microns.

In another possible embodiment the glass fibers have an average fiber diameter of less than 3.0 microns. In yet another embodiment the glass fibers have an average fiber diameter of less than 2.8 microns.

In accordance with an additional aspect of the present invention, a high temperature kitchen appliance is provided. That appliance comprises a housing, a heating element carried on the housing and an insulation element insulating at least a portion of the housing. The insulation element includes glass fibers having an average diameter of between about 2.7 and about 3.8 microns.

In accordance with yet another aspect of the present invention an oven range is provided comprising a housing, a heating element carried on the housing and an insulation element insulating at least a portion of that housing. The insulation element includes glass fibers having an average fiber diameter of between about 2.7 and about 3.8 microns. In other embodiments the glass fibers have an average fiber diameter of less than about 3.0 or less than about 2.8 microns.

Still further, the present invention includes a water heater comprising an inner tank including a water inlet and a water outlet, an outer jacket received around the inner tank, a heating chamber adjacent the inner tank in the outer jacket and an insulation element. The insulation element is carried by one of the inner tank and the outer jacket. The insulation element comprises glass fibers having an average fiber diameter of between about 2.7 to about 3.8 microns. In other embodiments, the glass fibers have an average fiber diameter of less than about 3.0 or less than about 2.8 microns.

In the following description there is shown and described several different embodiments of the invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of this specification, illustrates several aspects of the present invention, and together with the description serves to explain certain principles of the invention. In the drawing.

Reference will now be made in detail to the present preferred embodiments of the invention, examples of which are illustrated in the accompanying drawing.

DETAILED DESCRIPTION AND PREFERRED EMBODIMENTS OF THE INVENTION

The present invention is particularly suited for use in high temperature appliance and equipment applications. High temperature is defined as an operating temperature of about 200 degrees F. or above.

Figure 1:
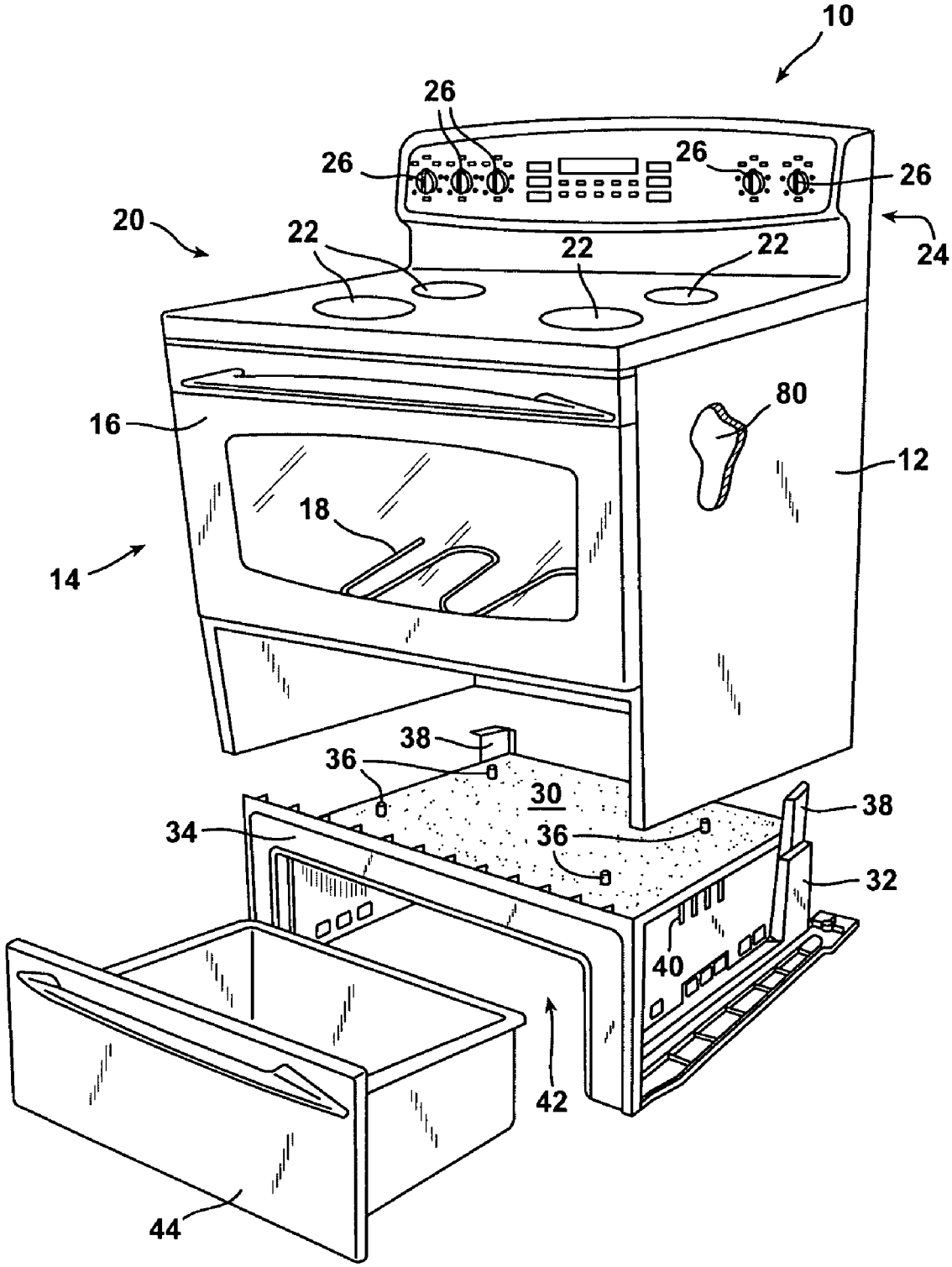
FIG. 1 is a partially cutaway, perspective view of an oven range equipped with the insulation blanket of the present invention.

Reference is now made to FIG. 1 illustrating a high temperature appliance in the form of an oven range 10. It should be appreciated that an oven range 10 is presented only for purposes of illustration and that the present invention relates to other high temperature appliances including but not limited to grills, commercial ovens, industrial equipment including ovens, incinerators, HVAC equipment and the like. The oven range 10 incorporates a housing 12 carrying an oven section 14 including a front access door 16 and a heating element 18, a range section 20 incorporating four burners 22 and a control section 24 including the oven and burner control switches 26. An insulation element 30 is provided in the hollow wall of the housing 12 and between the oven range 10 and the underlying composite base support 32. As illustrated, the support 32 includes a series of molded in features such as a front face panel 34, insulation retention tabs 36, mounting brackets 38 and air circulation vents 40. The support 32 also includes a cavity 42 for receiving a sliding drawer 44.

Figure 2:
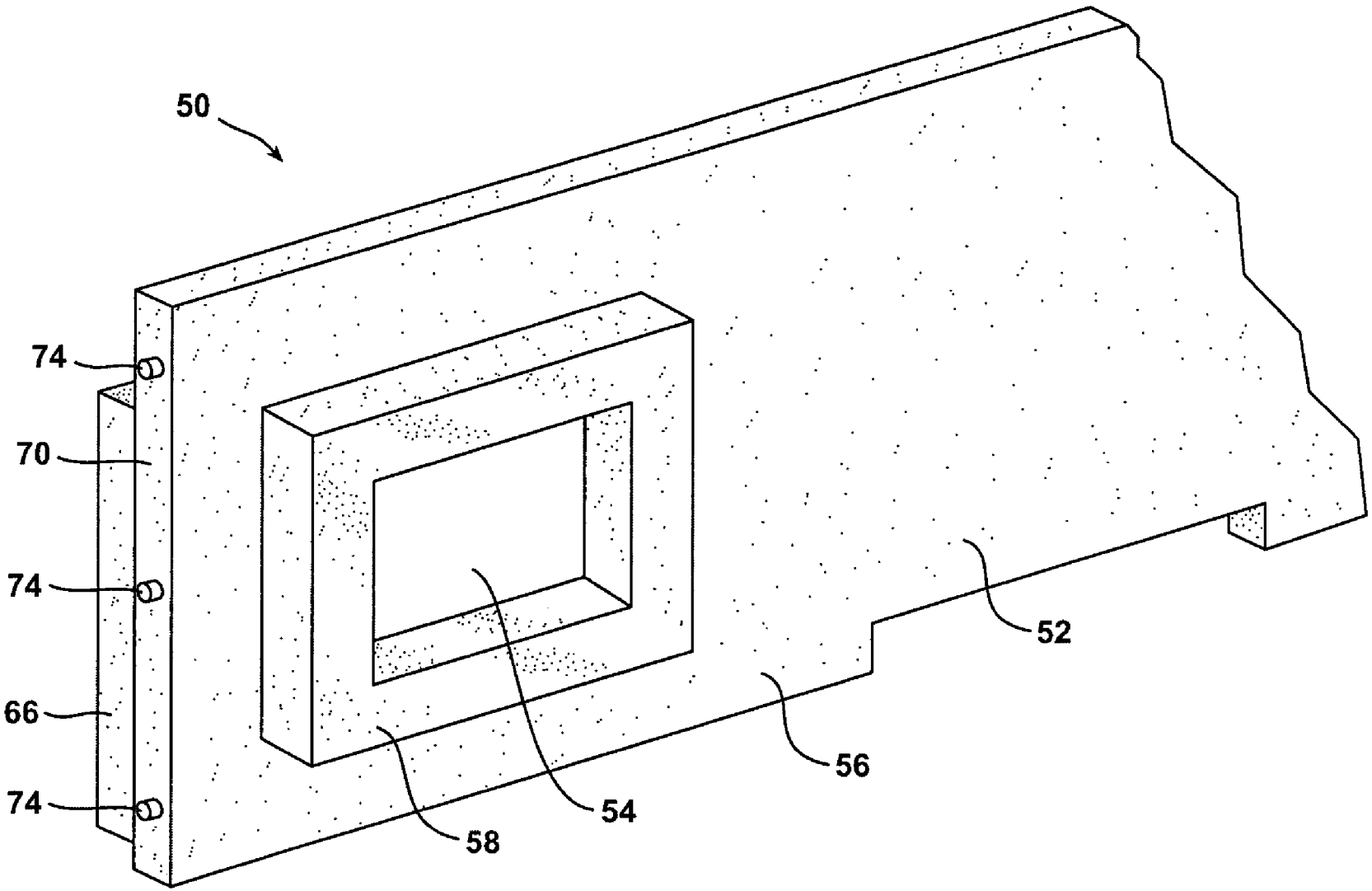
FIG. 2 is a perspective view of an insulation wrap for a water heater.
Figure 3:
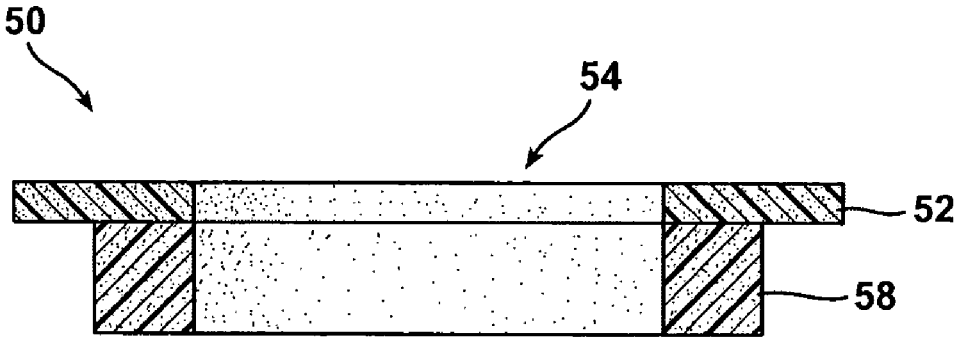
FIG. 3 is a cross section of the wrap shown in FIG. 2.
Figure 4:
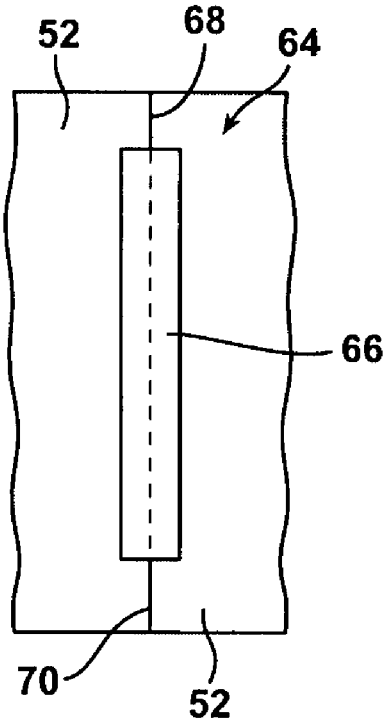
FIG. 4 is a detailed side elevational view illustrating the connection between the two ends of the wrap illustrated in FIG. 2 by means of an adhesive tape.
Figure 6:
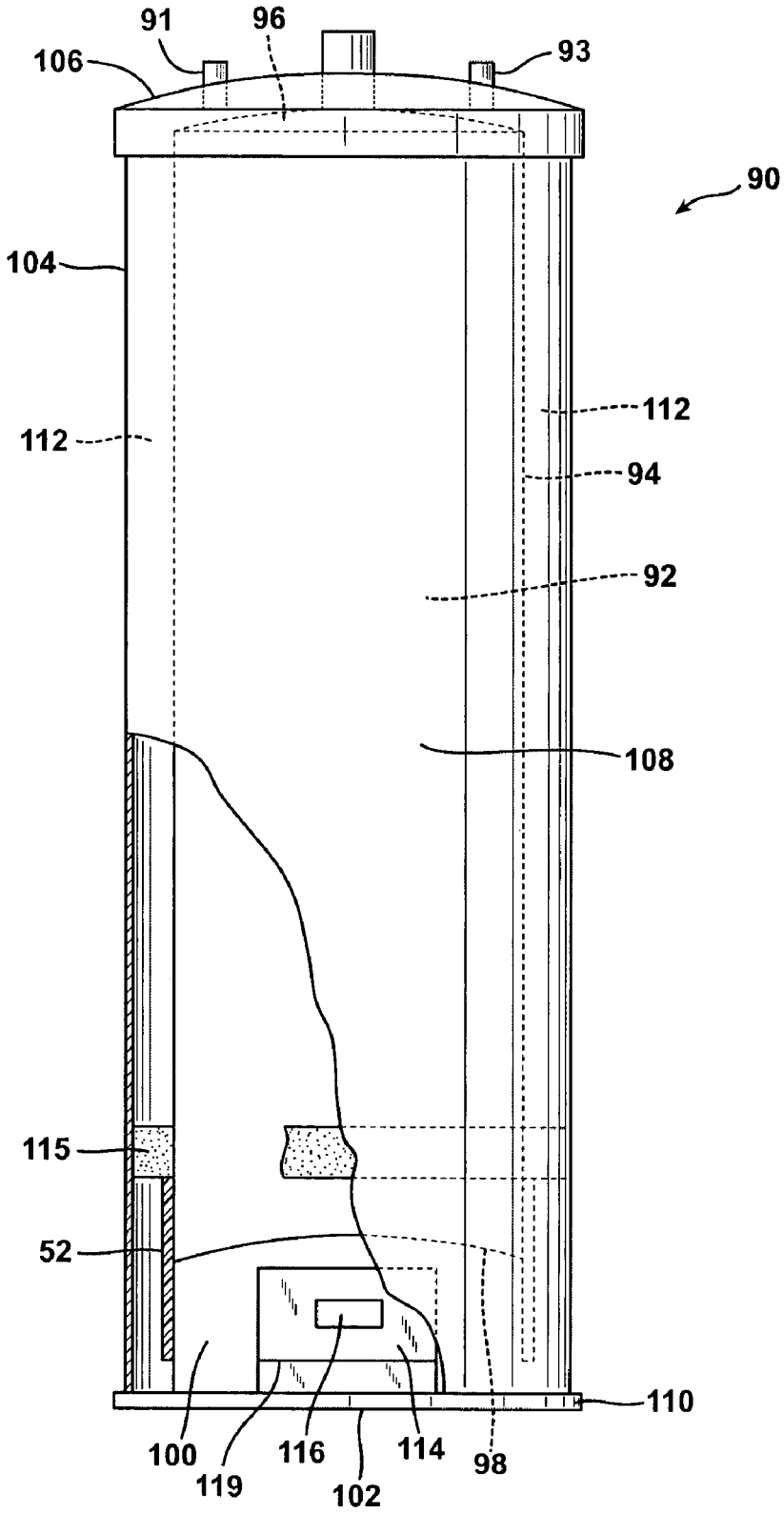
FIG. 6 is a schematical representation of a water heater in elevation with a partial cutaway section to show how the wrap is applied and positioned in the water heater.
Figure 8:
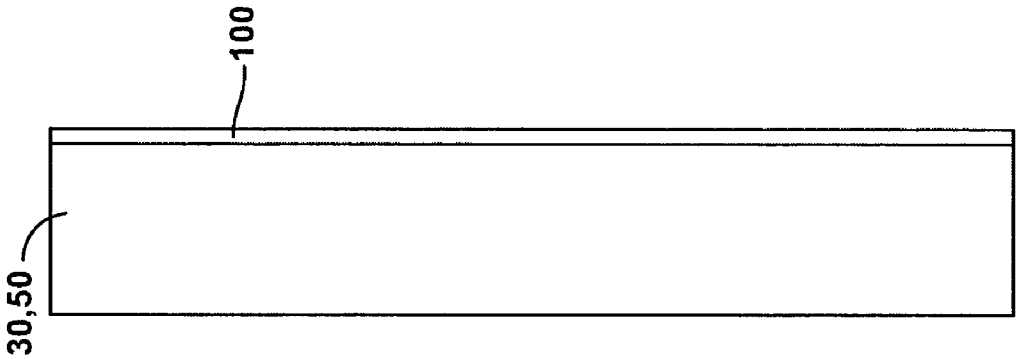
FIG. 8 is an end elevational view illustrating an insulation element including a facing.
Figure 7:
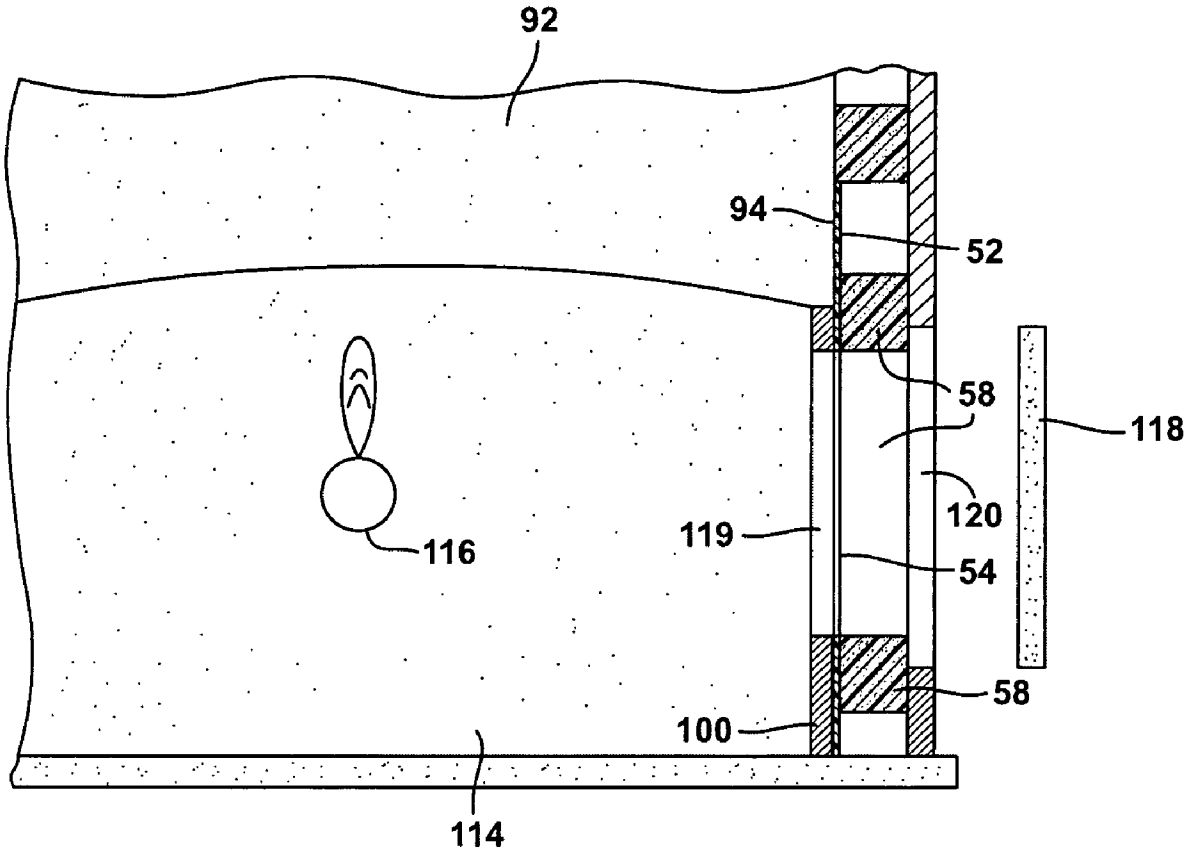
FIG. 7 is a schematical and cross-sectional view illustrating the relationship of the opening in the wrap relative to the access opening in the outer jacket and the heating chamber.

Reference is now made to FIGS. 2, 3 and 4 showing a first embodiment of the insulation wrap 50 of the present invention. As should be appreciated, such an insulation wrap 50 is particularly useful to insulate a water heater tank of a hot water heater as illustrated in FIGS. 6 and 7.

As illustrated, the insulation wrap 50 comprises a strip 52 of nonflammable fibrous material such as fibreglass. An opening 54 is provided in a face 56 of the strip 52. A fibrous material element 58 outlines at least a portion of the opening 54. For most applications, the wrap 50 including both the strip 52 and the element 58, fully outlines or encompasses the opening 54.

The fibreglass comprising the strip 52 is needled so as to form a consolidated mat or blanket. Thus, the strip 52 possesses not only insulation properties but is also heat and flame resistant. Accordingly, the strip 52 is particularly suited for insulating the inner tank of a water heater in and around the area of the heating chamber and burner as will be described with reference to FIGS. 6 and 7 in greater detail below.

As illustrated in FIG. 4, each strip 52 may include a fastener 64 illustrated as an adhesive backed metallic foil tape 66. Thus, the insulation wrap 50 may be formed into a ring with two abutting ends 68, 70 that are positively secured or locked together by the tape 66.

Figure 5:
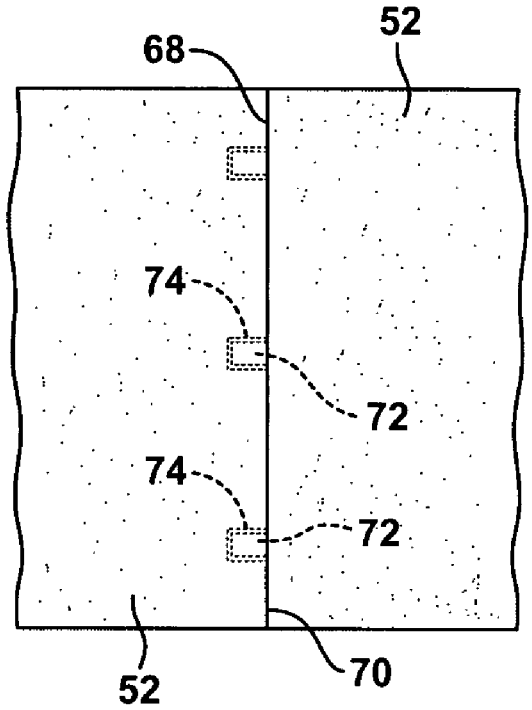
FIG. 5 is a detailed side elevational view illustrating the connection between the two ends of the wrap illustrated in FIG. 2 by means of cooperating male and female connectors.

In an alternative embodiment shown in FIG. 5, the strip 52 includes interlocking structures in the form of multiple projecting lugs 72 at a first end 68 and cooperating multiple apertures or sockets 74 sized and shaped to receive the lugs on the second, opposite end 70. As illustrated in FIG. 5, the lugs 72 are fully received and fit snugly in the apertures or sockets 74 allowing the ends 68, 70 of the strip 52 to abut one another when the ends are joined to form the insulation wrap 50 into a ring. Of course, it should be appreciated that the interlocking structure (i.e. the lugs 72 and apertures/sockets 74) also allow multiple strips to be joined together end to end to provide a wrap 50 of added length if desired for any particular application.

A hot water heater 90 incorporating the insulation wrap 50 is illustrated in FIGS. 6 and 7. The hot water heater 90 includes a cylindrical inner tank 92 for holding hot water, a water inlet 91 and a water outlet 93. The inner tank 92 includes a sidewall 94, a top wall 96 and a bottom wall 98. The bottom wall 98 of the tank 92 rests upon a support ring 100 which in turn rests upon a support plate 102.

As also illustrated in FIGS. 6 and 7, the hot water heater 90 includes an outer shell or jacket 104 having a top 106, a cylindrical sidewall 108 and a bottom edge 110. As illustrated, the jacket 104 is coaxial with and radially spaced from the tank 92, thereby forming an annular space or void 112 between the outer surface of the tank 92 and the inner surface of the jacket 104. As further illustrated, the bottom edge 110 of the jacket 104 rests upon the support plate 102.

The support ring 100 and the jacket 104 each include openings 119, 120 that register with each other to provide access to a heating chamber 114 located under the bottom 98 of the tank 92. A gas burner 116 is located within the heating chamber 114. A foam dam 115 is compressed between the sidewall 94 of the tank 92 and the sidewall 108 of the outer jacket 104 as the jacket is positioned over the tank during the assembly process. The void 112 above the foam dam 115 is filled with a polymer foam that is expanded directly in that void or annular space.

The insulation wrap 50 is wrapped around the outer surface of the sidewall 94 of the tank 92 so that the opening 54 in the strip 52 is aligned with the opening 119 in the support ring 100 that allows access to the heating chamber 114 and the burner 116. As the outer shell or jacket 104 is positioned over the tank 92, an access door 118 in the outer shell or jacket 104 is also aligned with the opening 54. The access door 118 is removed in order to allow access to the gas burner 116 in the heating chamber 114. As illustrated, the fibrous material element 58 is outlining the opening 54 fits snugly between the margin of the outer shell or jacket 104 surrounding the access opening 120 therein and the opening 119 in the support ring 100 that provides access to the heating chamber 114. Accordingly, it should be appreciated that the fibrous material element 58 prevents drafts from around the edge of the access door from reaching the gas burner 116 in the heating chamber 114 during water heater operation. Consequently, the only air drawn into the heating chamber 114 to support combustion of the burner flame is from around the bottom of the water heater. This advantageously serves to provide a more consistent burning flame and more efficient heating of water in the tank 92.

The insulation wrap 50 is of a length substantially corresponding to the circumference of the inner tank 92 so that the ends 68, 70 may be joined together and interlocked by either the adhesive backed tape 66 illustrated in FIG. 4 or the cooperating projecting lugs 72 and apertures/sockets 74 illustrated in FIG. 5 or even a combination of both.

The element or insulation blanket 30 of the oven range 10 of FIG. 1 and the element or insulation wrap 50 of the water heater 90 of FIGS. 2-7 comprises glass fibers having an average diameter of between about 2.7 and about 3.8 microns. The lower the average diameter of the glass fibers used in the insulation element 30, 50, the lower the thermal conductivity or k-value of the insulation and the lower the k-value at elevated temperatures for densities in the range of about 0.5 pcf to about 6 pcf. The insulator element 30, 50 of the present invention provides better thermal insulation while using less glass fiber material. Thus, the insulation element 30, 50 weighs less than prior art insulating elements providing equivalent thermal insulating performance and also costs less to product. This point is clearly illustrated by the following test data.

Comparative thermal conductivity and density data are provided for two different insulation elements 30 in Table A below. The test method used is ASTM C177.

Thermal Conductivity - Test Data

| Density (lbs/ft$^2$) | k-3.8 micron (500° F. Mean) | k-5.6 micron (500° F. Mean) |
|---|---|---|
| 0.98 | 0.716 | |
| 1.15 | 0.592 | |
| 1.61 | 0.526 | |
| 2.28 | 0.451 | |
| 3.38 | 0.406 | |
| 1.06 | | 0.758 |
| 1.79 | | 0.582 |
| 2.48 | | 0.493 |
| 3.71 | | 0.443 |

The first element 30, 50 has an average fiber diameter of 3.8 microns while the second element 30, 50 has an average fiber diameter of 5.6 microns. The lower the thermal conductivity number the better the performance of the thermal insulation.

As illustrated, when tested at a 500° F. mean temperature an insulation element with an average fiber diameter of 3.8 microns and a density of only 0.98 lbs/ft$^3$ outperforms an insulation element with an average fiber diameter of 5.6 microns and a density of 1.06 lbs/ft$^3$. Similarly an insulation element with an average fiber diameter of 3.8 microns and a density of 3.38 lbs/ft$^3$ outperforms an insulation element with an average fiber diameter of 5.6 microns and a density of 3.71 lbs/ft$^3$.

The insulation element 30, 50 may further include any conventional binder such as polyacrylic acid. Other potentially useful binders include but are not limited to phenol-formaldehyde, urea-formaldehyde, a polycarboxylic based binder, a polyacrylic acid glycerol (PAG) binder, a polyacrylic acid triethanolamine (PAT) binder, inorganic binders such as sodium silicates and aluminum polyphosphates and mixtures thereof. Useful polycarboxy binder compositions include polycarboxy polymer, a cross linking agent and optionally, a catalyst. Examples of such binders are disclosed in U.S. Pat. No. 5,318,990 to Straus, U.S. Pat. No. 5,340,868 to Straus et al., U.S. Pat. No. 5,661,213 to Arkens et al., U.S. Pat. No. 6,274,661 to Chen et al, U.S. Pat. No. 6,699,945 to Chen et al. and U.S. Pat. No. 6,884,849 to Chen et al. The binder may be present in an amount of from less than or equal to about 10% by weight and more preferably in an amount from less than or equal to about 3% by weight of the total product. The low amount of binder contributes to the flexibility of the product. Typically the insulation element 30, 66 includes about 98 weight percent glass fibers and about 2 weight percent binder. The glass fibers may have lengths greater than about ¼".

Alternatively, the insulation element 30, 50 may not include a binder and may be bonded using mechanical means including but not limited to needling, stitching and/or hydroentangling. Facings 100 such as glass mats and aluminum foils may be used on one or more sides of the insulation element 30, 50 for securing the fibers or for encapsulation (see FIG. 3). For high temperature applications of the type contemplated, the insulation element 30, 50 is made substantially free of thermoplastic fibers in order to maintain its shape and structural integrity. For purposes of this document, "substantially free" means having an insufficient amount of thermoplastic fibers to cause the insulation element to lose shape retention and/or structural integrity when used for its intended application.

The insulation element 30, 50 of the present invention may be manufactured in a continuous process as described in co-pending U.S. patent application Ser. No. 11/179,174, entitled Thin Rotary-Fiberized Glass Insulation and Process for Producing Same and filed on Jul. 12, 2005. More specifically, this process includes the step of fiberizing molten glass, spraying binder onto the fibers, forming a single component fibrous glass insulation pack on a moving conveyor, curing the binder on the fibrous glass insulation pack to form an insulation blanket.

More specifically, the glass is first melted in a tank and then supplied to a fiber forming device such as a fiberizing spinner. The spinner is rotated at a high speed so that centrifugal force causes the molten glass to pass through holes in the sidewalls of the spinner to form glass fibers. Single component glass fibers of random lengths may be attenuated from the fiberizing spinner and blown generally downwardly, that is, generally perpendicular to the plane of the spinner by blowers positioned within a forming chamber.

The blowers turn the fibers down to form a veil or curtain. The glass fibers may have a fiber diameter of from about 2 to about 9 microns and a length of from about ¼ to about 4 inches. The small diameter of the glass fibers of the insulation as described below helps give the final insulation element 30, 50 a soft feel.

The glass fibers, while still hot from the drawing operation are sprayed with an aqueous binder composition incorporating an appropriate conventional binder as described above. The glass fibers, with the uncured resinous binder adhered thereto, are then gathered and formed into an uncured insulation pack on an endless forming conveyor within the forming chamber with the aide of a vacuum drawn through the insulation pack from below the forming conveyor. The residual heat from the glass fibers and the flow of air through the insulation pack during the forming operation are generally sufficient to volatalize the majority of the water from the binder before the glass fibers exit the forming chamber, thereby leaving the remaining components of the binder on the fibers as a viscous or semi-viscous high-solids liquid.

The coated insulation pack, which is in a compressed state due to the flow of air through the pack, is then transferred from the forming chamber under exit roller to a transfer zone where the insulation pack vertically expands due to resiliency of the glass fibers. The expanded insulation pack is then heated, such as by conveying the pack through a curing oven where heated air is blown through the insulation pack to evaporate any remaining water in the binder, cure the binder and residually bond the fibers together.

The cured binder imparts strength and resiliency to the insulation blanket. It is anticipated that the drying and curing of the binder may be carried out in either one or two different steps. If desired, the insulation pack may be compressed by upper and lower oven conveyors in the curing oven in order to form a fibrous insulation blanket of desired thickness. The curing oven may be operated at temperatures at from, for example, about 200° C. to about 325° C. The insulation pack remains within the oven for a period of time sufficient to cross link the binder and form the insulation blanket. Typical residence times in the oven are in the range of about 30 seconds to about 3 minutes. After cooling, the insulation blanket may be rolled by a roll-up device for shipping or for storage for use at a later time. Alternatively, the insulation element 30, 50 may be cut to size from the blanket.

If desired, the insulation blanket may be subsequently subjected to an optional needling process in which barbed needles are pushed in a downward and upward motion through the fibers of the insulation blanket to entangle or intertwine the fibers and impart mechanical strength and integrity. Needling the insulation blanket also increases the density and reduces the overall thickness of the blanket. The needling process or needle punching may take place with or without a precursor step of lubricating.

In an alternative approach, glass fibers are processed without adding any aqueous binder composition. In this instance, the glass fibers are bound together using mechanical means including but not limited to needling, stitching and hydroentangling. Further, facings of, for example, glass mat and/or metal foils may be used on one or both sides to secure the fibers or for encapsulation.

The needling process may be implemented using a needling apparatus. Such a needling apparatus may include a web feeding mechanism, a needle beam with a needle board, needles, such as, for example, ranging in number from about 500 per meter to about 10,000 per meter of machine width, a stripper plate, a bed plate and a take-up mechanism. Rollers may also be provided to move the insulation blanket through the needling apparatus during the needling process and/or to compress the insulation blanket prior to the element entering the needling apparatus.

The needles may be pushed in and out of the insulation blanket at about 100 to about 1,500 strokes per minute. The needles may have a gauge (size) in the range of from about 9 to about 43 gauge and may range in length from about 3 to about 4 inches. The needling apparatus may include needles having the same size, or, alternatively, a combination of different sized needles may be included. The punch density is preferably about 5 to about 100 punches per square centimeter. The punching depth or degree of penetration of the needles through the insulation blanket and into the bed plate of the needling apparatus is preferably about 0.25 to about 0.75 inches when needling from one side.

After passage through the needling apparatus, the needled insulation blanket may be rolled by a roll-up device for shipping or for storage for use at a later time. Alternatively, insulation element 30, 50 may be cut to size from the blanket before or after needling.

The foregoing description of preferred embodiments of the invention has been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one or ordinary skill in the art to utilize the invention in various embodiments and with various modifications as is suited a particular use contemplated. All such modifications and variations are within the scope of the invention as determined by the appended claims when interpreted in accordance with the breadth to which they are fairly, legally and equitably entitled.

What is claimed:

1. An insulation for high temperature applications, comprising glass fibers having an average fiber diameter of between about 2.7 to about 3.8 microns, said insulation being substantially free of thermoplastic fibers and having an average density of between about 0.5 lb/ft$^3$ and about 6.0 lb/ft$^3$, wherein the thermal conductivity of said insulation at 500 degrees F. is less than the thermal conductivity of an insulation material having an average density substantially the same as said insulation and glass fibers with an average fiber diameter greater than said glass fibers of said insulation.

2. The insulation of claim 1, wherein said glass fibers have an average fiber diameter of less than about 3.0 microns.

3. The insulation of claim 1, wherein said glass fibers have an average fiber diameter of less than about 2.8 microns.

4. A high temperature appliance, comprising:

a housing;

a heating element carried by said housing; and an insulation element insulating at least a portion of said housing, said insulation element including glass fibers having an average fiber diameter of between about 2.7 and about 3.8 microns, said insulation element being substantially free of thermoplastic fibers and having an average density of between about 0.5 lb/ft$^3$ and about 6.0 lb/ft$^3$, wherein the thermal conductivity of said insulation element at 500 degrees F. is less than the thermal conductivity of an insulation material having an average density substantially the same as said insulation element and glass fibers with an average fiber diameter greater than said glass fibers of said insulation element.

5. The appliance of claim 4, wherein said insulation includes about 98 weight percent glass fibers and about 2 weight percent binder.

6. The appliance of claim 5, wherein said binder is selected from a group consisting of polyacrylic acid, phenol-fomaldehyde, urea-formaldehyde, a polycarboxylic based binder, a polyacrylic acid glycerol (PAG) binder, a polyacrylic acid triethanolamine (PAT) binder, a polycarboxy binder, an inorganic binder and mixtures thereof.

7. The appliance of claim 6, wherein said insulation element is needled.

8. The appliance of claim 6, wherein said glass fibers have an average fiber diameter of less than 3.0 microns.

9. The appliance of claim 6, wherein said glass fibers have an average fiber diameter of less than 2.8 microns.

10. The appliance of claim 6, wherein said insulation element further comprises a facing on at least one side.

11. An oven range, comprising:

a housing;

a heating element carried on said housing; and an insulation element insulating at least a portion of said housing, said insulation element including glass fibers having an average fiber diameter of between about 2.7 and about 3.8 microns, said insulation element being substantially free of thermoplastic fibers and having an average density of between about 0.5 lb/ft$^3$ and about 6.0 lb/ft$^3$, wherein the thermal conductivity of said insulation element at 500 degrees F. is less than the thermal conductivity of an insulation material having an average density substantially the same as said insulation element and glass fibers with an average fiber diameter greater than said glass fibers of said insulation element.

12. The oven range of claim 11, wherein said insulation includes about 98 weight percent glass fibers and about 2 weight percent binder.

13. The oven range of claim 12, wherein said binder is selected from a group consisting of polyacrylic acid, phenol-fomaldehyde, urea-formaldehyde, a polycarboxylic based binder, a polyacrylic acid glycerol (PAG) binder, a polyacrylic acid triethanolamine (PAT) binder, a polycarboxy binder, an inorganic binder and mixtures thereof.

14. The oven range of claim 13, wherein said insulation element is needled.

15. The oven range of claim 13, wherein said glass fibers have an average fiber diameter of less than 3.0 microns.

16. The oven range of claim 13, wherein said glass fibers have an average fiber diameter of less than 2.8 microns.

17. A water heater, comprising:

an inner tank including a water inlet and a water outlet;

an outer jacket received around said inner tank, a heating chamber adjacent said inner tank in said outer jacket; and an insulation element carried by one of said inner tank and said outer jacket, said insulation element comprising glass fibers having an average fiber diameter of between about 2.7 and about 3.8 microns, said insulation element being substantially free of thermoplastic fibers and having an average density of between about 0.5 lb/ft$^3$ and about 6.0 lb/ft$^3$, wherein the thermal conductivity of said insulation element at 500 degrees F. is less than the thermal conductivity of an insulation material having an average density substantially the same as said insulation element and glass fibers with an average fiber diameter greater than said glass fibers of said insulation element.

18. The water heater of claim 17, wherein said glass fibers have an average fiber diameter of less than about 3.0 microns.

19. The water heater of claim 17, wherein said glass fibers have an average fiber diameter of less than about 2.8 microns.

20. The water heater of claim 17, wherein said insulation element further comprises a facing on at least one side.

21. The insulation of claim 1, wherein the average density of the insulation is between about 0.98 lb/ft$^3$ and about 3.38 lb/ft$^3$ and the k value of the insulation at 500 degrees F. is between about 0.716 and 0.406.

22. An insulation, comprising: glass fibers having an average fiber diameter of between about 2.7 and about 3.8 microns, wherein the insulation has an average density of between about 0.5 $lb/ft^3$ and about 6.0 $lb/ft^3$ and a thermal conductivity at 500 degrees F. less than the thermal conductivity of an insulation material having an average density substantially the same as the insulation and glass fibers with an average fiber diameter greater than the glass fibers of the insulation.

23. The insulation of claim 22, wherein the glass fibers have an average fiber diameter of less than 3 microns.

* * * * *